US007201506B2

(12) United States Patent
Ishida et al.

(10) Patent No.: US 7,201,506 B2
(45) Date of Patent: Apr. 10, 2007

(54) VEHICULAR HEADLAMP WITH SEMICONDUCTOR LIGHT EMITTING ELEMENTS AND ELECTRIC DISCHARGE BULB

(75) Inventors: Hiroyuki Ishida, Shizuoka (JP); Kiyoshi Sazuka, Shizuoka (JP); Masashi Tatsukawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 183 days.

(21) Appl. No.: 10/979,255

(22) Filed: Nov. 3, 2004

(65) Prior Publication Data

US 2005/0094414 A1 May 5, 2005

(30) Foreign Application Priority Data

Nov. 4, 2003 (JP) ..... P.2003-374059

(51) Int. Cl.
*F21V 29/00* (2006.01)

(52) U.S. Cl. ..... 362/544; 362/253; 362/507; 362/545

(58) Field of Classification Search ..... 362/253, 362/507, 543–545
See application file for complete search history.

(56) References Cited

U.S. PATENT DOCUMENTS 5,954,428 A * 9/1999 Eichhorn et al. ..... 362/543
6,540,387 B2 * 4/2003 Hashiyama et al. ..... 362/538
6,637,923 B2 * 10/2003 Amano ..... 362/545
6,746,143 B1 * 6/2004 Van Duyn ..... 362/539
7,001,054 B2 * 2/2006 Koizumi et al. ..... 362/545
7,048,412 B2 * 5/2006 Martin et al. ..... 362/247

FOREIGN PATENT DOCUMENTS

JP 2003-7104 A 1/2003
JP 2003-123517 A 4/2003

* cited by examiner

*Primary Examiner*—Sandra O'Shea
*Assistant Examiner*—Jason Moon Han
(74) *Attorney, Agent, or Firm*—Sughrue Mion, PLLC

(57) ABSTRACT

A plurality of lamp piece units constituting light sources by semiconductor light emitting elements are used as a first lamp piece unit which is lighted in a low beam mode. Additionally, a single lamp piece unit constituting a light source by an electric discharge bulb color temperature of emitted light of which is as high as that of the semiconductor light emitting element, is used as a second lamp piece unit, which is additionally lighted in a high beam mode. When the beam is switched from the low beam to the high beam, pale irradiated light from the first lamp piece unit is added with pale irradiated light from the second lamp piece unit to thereby provide an impression for the driver and/or passenger of unity in colors between the two lamp piece units.

12 Claims, 9 Drawing Sheets

VEHICULAR HEADLAMP WITH SEMICONDUCTOR LIGHT EMITTING ELEMENTS AND ELECTRIC DISCHARGE BULB

The present application claims foreign priority based on Japanese Patent Application No. 2003-374059, filed Nov. 4, 2003, the contents of which is incorporated herein by reference.

1. Field of the Invention

The present invention relates to a vehicular headlamp including a lamp piece unit constituting a light source by a semiconductor light-emitting element.

2. Background of the Invention

In the related art, a vehicular headlamp is constituted to be able to switch a beam between a low beam and a high beam setting. More specifically, there is a related art vehicular headlamp constituted such that in a low beam mode a first lamp piece unit is lighted, and in a high beam mode the first lamp piece unit as well as a second lamp piece unit are simultaneously lighted.

In such a vehicular headlamp, Japanese patent publication JP-A-2003-7104 describes a vehicular headlamp using an electric discharge bulb as a light source of the first lamp piece unit and a halogen bulb as a lamp piece of the second lamp piece unit.

Further, Japanese patent publication JP-A-2003-123517 describes a vehicular headlamp including a plurality of lamp piece units each constituting a light source by a semiconductor light-emitting element.

When the lamp piece constitution described in JP '517 is adopted, the respective lamp piece units can be downsized. Therefore, the design of the lamp piece can be set comparatively freely by arranging the respective lamp piece units pertinently.

However, when the semiconductor light-emitting element is used as the light source, an amount of irradiated light from the lamp piece unit cannot be ensured sufficiently. Therefore, to enable the switching of the beam between the low beam and the high beam setting by the related art lamp piece constitution, several lamp piece units need to be used for the first lamp piece unit for the low beam and the second lamp piece unit which is additionally lighted in the high beam mode, respectively. As a result; there is a related art problem in that the number of the lamp piece units is considerably increased to result in deterioration in a degree of freedom of design of the lamp piece.

In contrast, when the plurality of lamp piece units each constituting the light source by the semiconductor light emitting element are used for the first lamp piece unit for the low beam mode requesting highly accurate control of light intensity distribution, the lamp piece unit constituting the light source by the halogen lamp as described in JP '104 is used for the second lamp piece unit which is lighted in the high beam mode, which needs a larger amount of light, the degree of freedom of design of the lamp piece can be increased without considerably increasing the number of the lamp piece units.

However, in this related art lamp, the color temperature of emitted light significantly differs between the semiconductor light emitting element and the halogen bulb. Therefore, the below-described related art problem occurs.

There is a related art problem of producing an unusual visual impression for a driver when the beam is switched from the low beam to the high beam. For example, yellowish irradiated light from the second lamp piece unit is added to pale irradiated light from the first lamp piece unit. Further, in the high beam mode simultaneously lighting the first and the second lamp piece units, there is also a related art problem in that an outlook of the lamp piece unit is deteriorated since a visual impression of unity in color between the two lamp piece units is not achieved.

SUMMARY OF THE INVENTION

The present invention has been carried out in view of such a situation. It is an object of the present invention to provide a vehicular headlamp capable of preventing an unusual visual impression from being given to a driver (or other person in the vehicle) when a beam is switched between a low beam and a high beam. It is another object of the present invention to achieve improvement of an outlook of a lamp piece when the lamp piece is lighted in a high beam mode in a vehicular headlamp, including a lamp piece unit constituting a light source by a semiconductor light-emitting element.

While the foregoing objects are provided for the present invention, it is not necessary for these objects to be achieved in order for the invention to operate properly. Further, other object, or no objects at all, may be achieved by the present invention without affecting its operation.

The invention devises a light source of a second lamp piece unit that is also lighted in a high beam mode.

More specifically, the vehicular headlamp according to the invention is characterized in a vehicular headlamp that can switch a beam between a low beam and a high beam, and constituted such that in a low beam mode a first lamp piece unit is lighted, and in a high beam mode the first lamp piece unit as well as a second lamp piece unit are simultaneously lighted. A plurality of lamp piece units each constituting a light source by a semiconductor light emitting element are used as the first lamp piece unit, and a single lamp piece unit constituting a light source by an electric discharge bulb is used as the second lamp piece unit.

A specific embodiment of each lamp piece unit constituting the "first lamp piece unit" is not particularly limited so far as each of the lamp piece units constitutes the light source by the semiconductor light-emitting element.

A kind of the "semiconductor-light emitting element" is not particularly limited but, for example but not by way of limitation, a light emitting diode, a laser diode or the like can be adopted therefor.

A specific constitution of the "second lamp piece unit" is not particularly limited so far as the second lamp piece unit constitutes the lamp piece by the electric discharge bulb.

As described above, in the vehicular headlamp according to the present invention, the plurality of light piece units each constituting the light source by the semiconductor light emitting element are used as the first lamp piece unit which is lighted in the low beam mode, the single lamp piece unit constituting the light source by the electric discharge bulb is used as the second lamp piece unit which is additionally lighted in the high beam mode. Therefore, the following operation and effect can be achieved.

By using the plurality of lamp piece units each constituting the light source by the semiconductor light-emitting element as the first lamp piece unit, a control of light intensity distribution in the low beam mode can accurately be carried out. Further, by using the lamp piece unit constituting the light source by the electric discharge bulb as the second lamp piece unit, a large amount of light can be ensured even by the single lamp piece unit. Therefore, an amount of irradiated light in the high beam mode can sufficiently be ensured by additionally lighting the second lamp piece unit. Thereby, the degree of freedom of design of the lamp piece can be increased without considerably increasing the number of the lamp piece units.

In that case, color temperature of emitted light of the electric discharge bulb is high, similar to the semiconductor light-emitting element. Therefore, when the beam is switched from the low beam to the high beam, pale irradiated light from the second lamp piece unit is added to pale irradiated light from the first lamp piece unit. Therefore, a visually unusual impression is not given to a driver or the like in switching the beam. Further, even in the high beam mode in which the first and the second lamp piece units are simultaneously lighted, there is a visual appearance of unity in color between the two lamp piece units. Therefore, the outlook of the lamp piece is not deteriorated.

In this way, according to the present invention, in the vehicular headlamp including the lamp piece constituting the light source by the semiconductor light-emitting element, the unusual visual impression is not given to the driver or other passenger in switching the beam between the low beam and the high beam. Accordingly, the outlook of the lamp piece can be promoted when the lamp piece is lighted in the high beam mode.

In the above-described constitution, when a white light emitting diode for emitting light at a color temperature of 4000 through 6500 K is used as the semiconductor light emitting element, and a metal halide bulb for emitting light at a color temperature of 4000 through 6500 K is used as the electric discharge bulb, irradiated light from the first lamp piece unit and irradiated light from the second lamp piece unit can uniformly be made to constitute colors substantially to the same degree and the operation and the effect can further be promoted thereby.

Although in the above-described constitution, the specific constitution of the respective lamp piece units constituting the first lamp piece unit is not particularly limited as described above, when each of the lamp piece units is constituted as a lamp piece unit of a projector type as in known in the art, in which each of the lamp piece units includes a projecting lens, and a reflector for reflecting light from the semiconductor light emitting element in a front direction on a rear side of the projecting lens, and a reflecting face of the reflector is constituted to converge light from the semiconductor light emitting element reflected by the reflecting face substantially to a vicinity of a focal point on the rear side of the projecting lens, a rate of utilizing a light flux with respect to the light from the semiconductor light emitting element can easily be increased and the number of lamp piece units constituting the first lamp piece unit can be reduced.

Further, although in the above-described constitution, the specific constitution of the second lamp piece unit is not particularly limited as described above, when the second lamp piece unit is constituted as a lamp piece unit of a parabola type in which the lamp piece unit is constituted to include a reflector for reflecting light from the electric discharge bulb in a front direction and a reflecting face of the reflector is formed by constituting a reference face by a paraboloid of revolution constituting a focal point substantially by a position of a light emitting element of the electric discharge bulb, a depth of the second lamp piece unit can be made to be comparatively short. Thus, the second lamp piece unit can be prevented from being projected significantly to a rear side relative to the respective lamp piece units constituting the first lamp piece unit.

Additionally, a vehicular headlamp is provided that is switchable between a low beam mode and a high beam mode. This vehicular headlamp includes a first lamp piece unit, comprising a plurality of lamp piece units each having a semiconductor light-emitting element as its light source, and a second lamp piece unit, comprising an electric discharge bulb as its light source. The first lamp piece unit is lighted in the low beam mode, and the first lamp piece unit and the second lamp piece unit are lighted substantially simultaneously in the high beam mode.

DETAILED DESCRIPTION OF THE INVENTION

Figure 1:
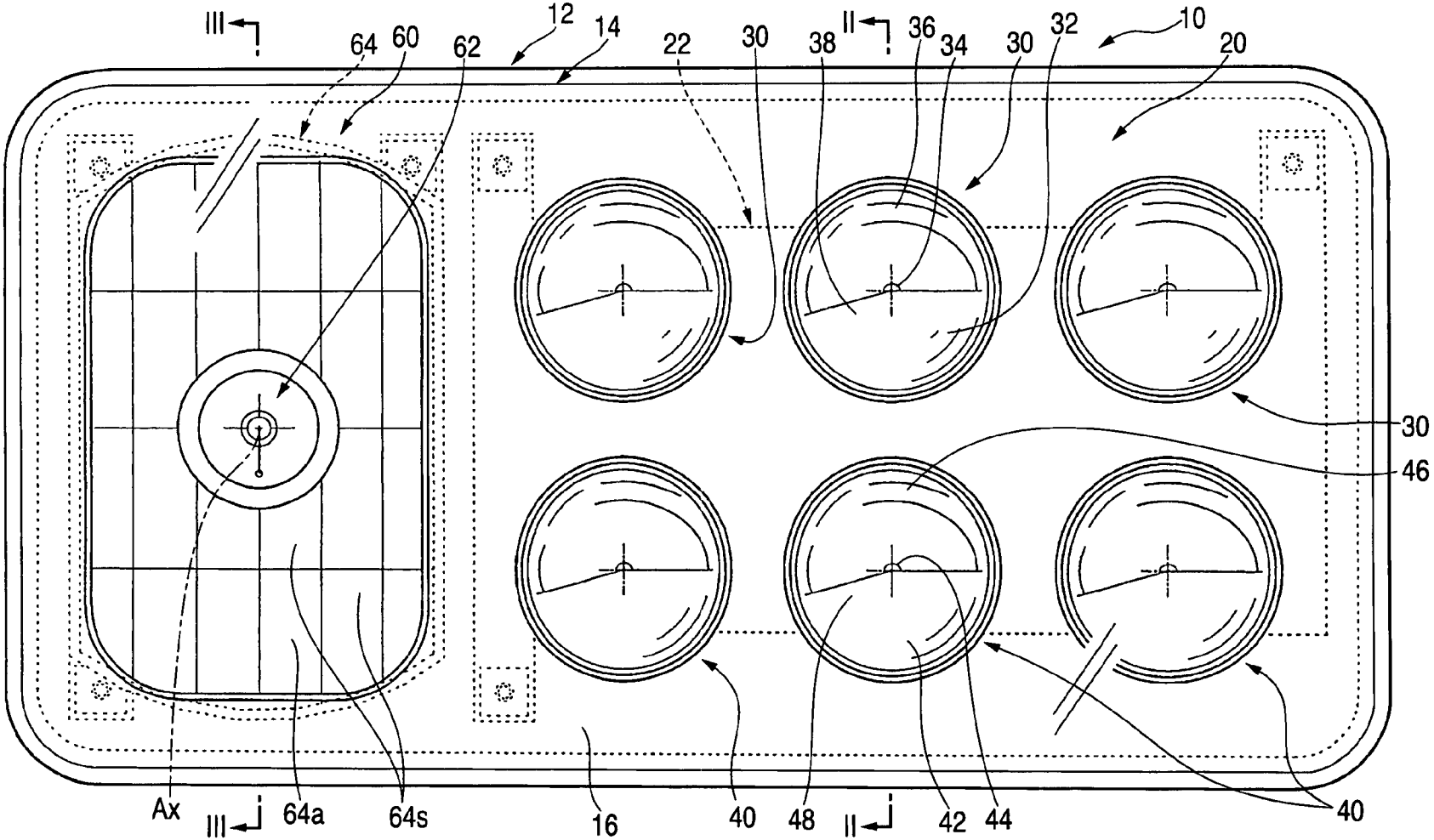
FIG. 1 is a front view showing a vehicular headlamp according to an exemplary, non-limiting embodiment of the present invention.

An embodiment of the invention will be explained in reference to the drawing as follows.

Figure 2:
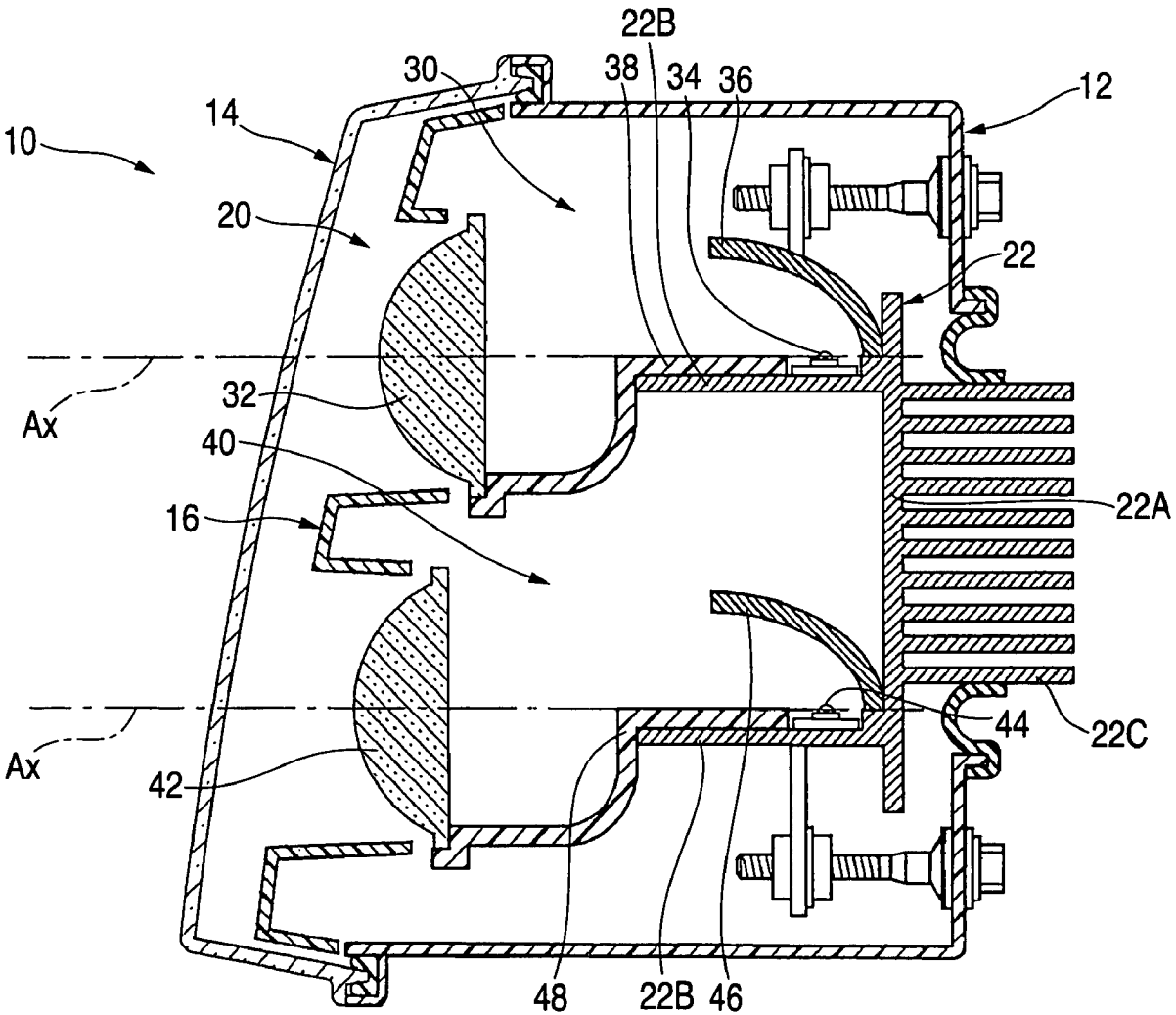
FIG. 2 is a sectional view taken along a line II—II of FIG. 1, according to the exemplary, non-limiting embodiment of the present invention.
Figure 3:
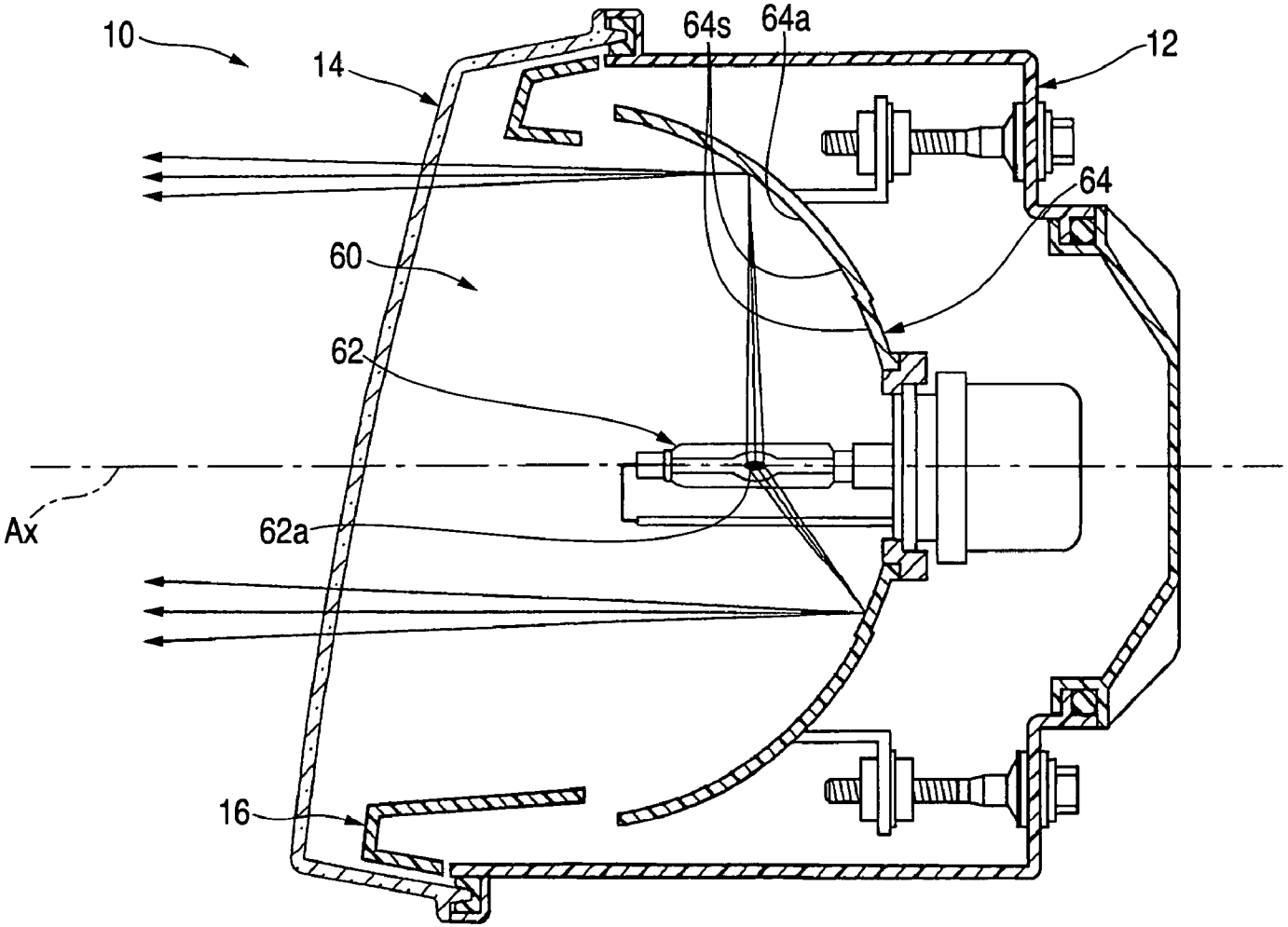
FIG. 3 is a sectional view taken along a line III—III of FIG. 1 according to the exemplary, non-limiting embodiment of the present invention.

FIG. 1 is a front view showing a vehicular headlamp according to an exemplary, non-limiting embodiment of the present invention, and FIGS. 2 and 3 are a sectional view taken along a line II—II of FIG. 1 and a sectional view taken along a line III—III thereof, respectively.

A vehicular headlamp 10 is constituted such that a first lamp piece unit 20 and a second lamp piece unit 60 are contained inside a lamp chamber formed by a lamp body 12 and a transparent light transmitting cover 14 attached to an opening portion of a front end thereof, to be inclinable in an up and down direction and a left and right direction, respectively, via aiming mechanisms arranged contiguously to the left and to the right. Further, an inner panel 16 formed to surround the first and the second lamp piece units 20, 60 is provided along the light transmitting cover 14 inside the lamp chamber.

The vehicular headlamp 10 is able to switch a beam between a low beam (or low beam mode) and a high beam (or high beam mode). Whereas the first lamp piece unit 20 is lighted in a low beam mode, both the first lamp piece unit 20 and the second lamp piece unit 60 are substantially simultaneously lighted in a high beam mode.

The first lamp piece unit 20 is supported by a support bracket 22 in a state of arranging six of lamp piece units 30; 40 are arranged in two upper and lower stages of threes. Each of six of the lamp piece units 30, 40 is constituted as a lamp piece unit of a projector type, and the three lamp piece units 30, 40 disposed at respective stages are respectively constructed by a substantially similar constitution. The support bracket 22 is preferably made by diecasting, and includes a vertical panel portion 22A, unit support portions 22B extended from the vertical panel portion 22A to a front side in a shelf-like configuration by being arranged in two upper and lower stages, and a heat sink portion 22C comprising a plurality of cooling fins extended from the vertical panel portion 22A to a rear side.

An optical axis of the first lamp piece unit 20 is adjusted such that optical axes Ax of the respective lamp piece units 30, 40 are directed downwardly by about 0.5 through 0.6° relative to a front and rear direction of a vehicle.

Figure 4:
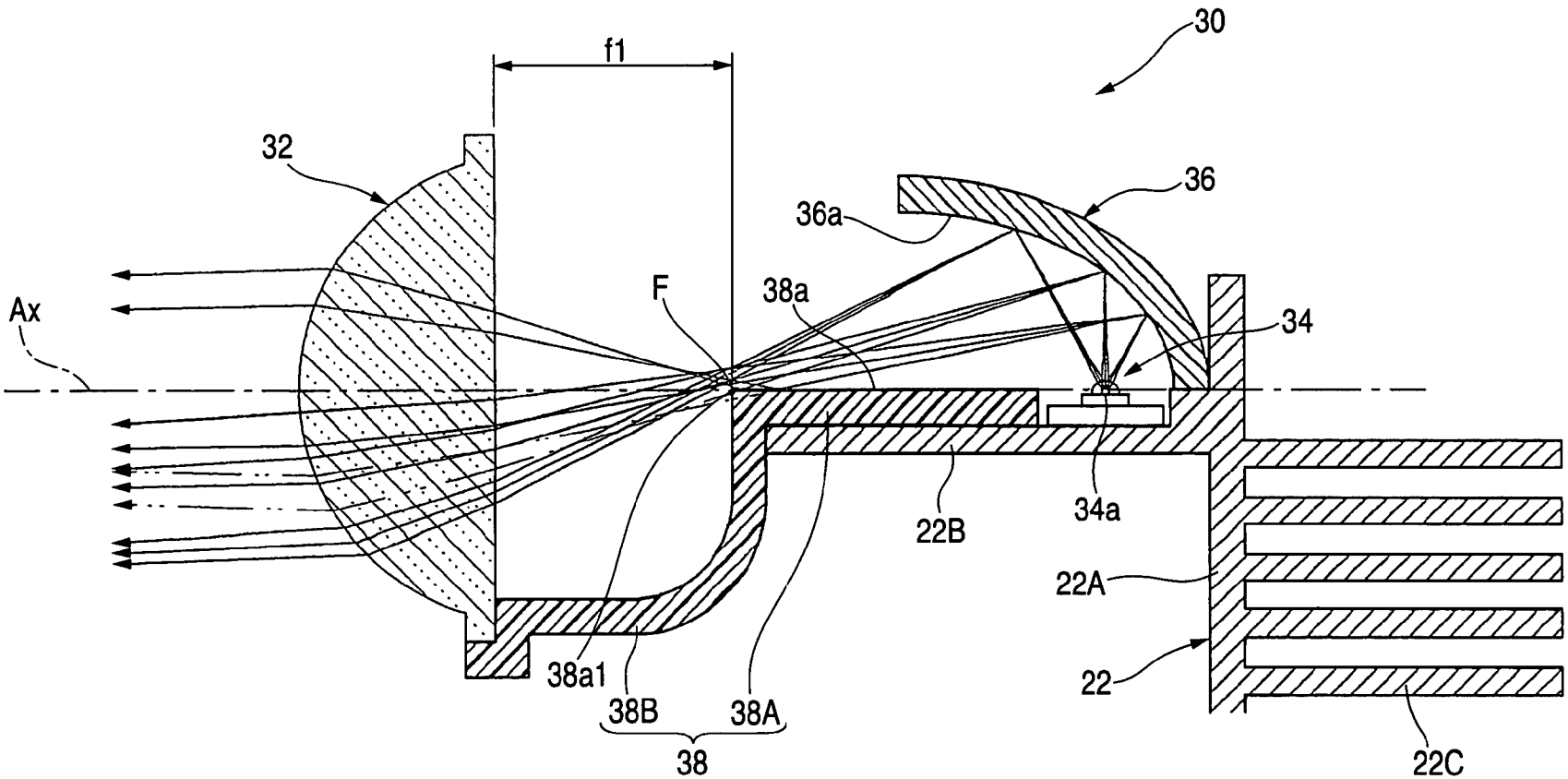
FIG. 4 is a side sectional view showing details of one of three lamp piece units disposed at an upper stage in a first lamp piece unit constituting the vehicular headlamp, according to the exemplary, non-limiting embodiment of the present invention.
Figure 5:
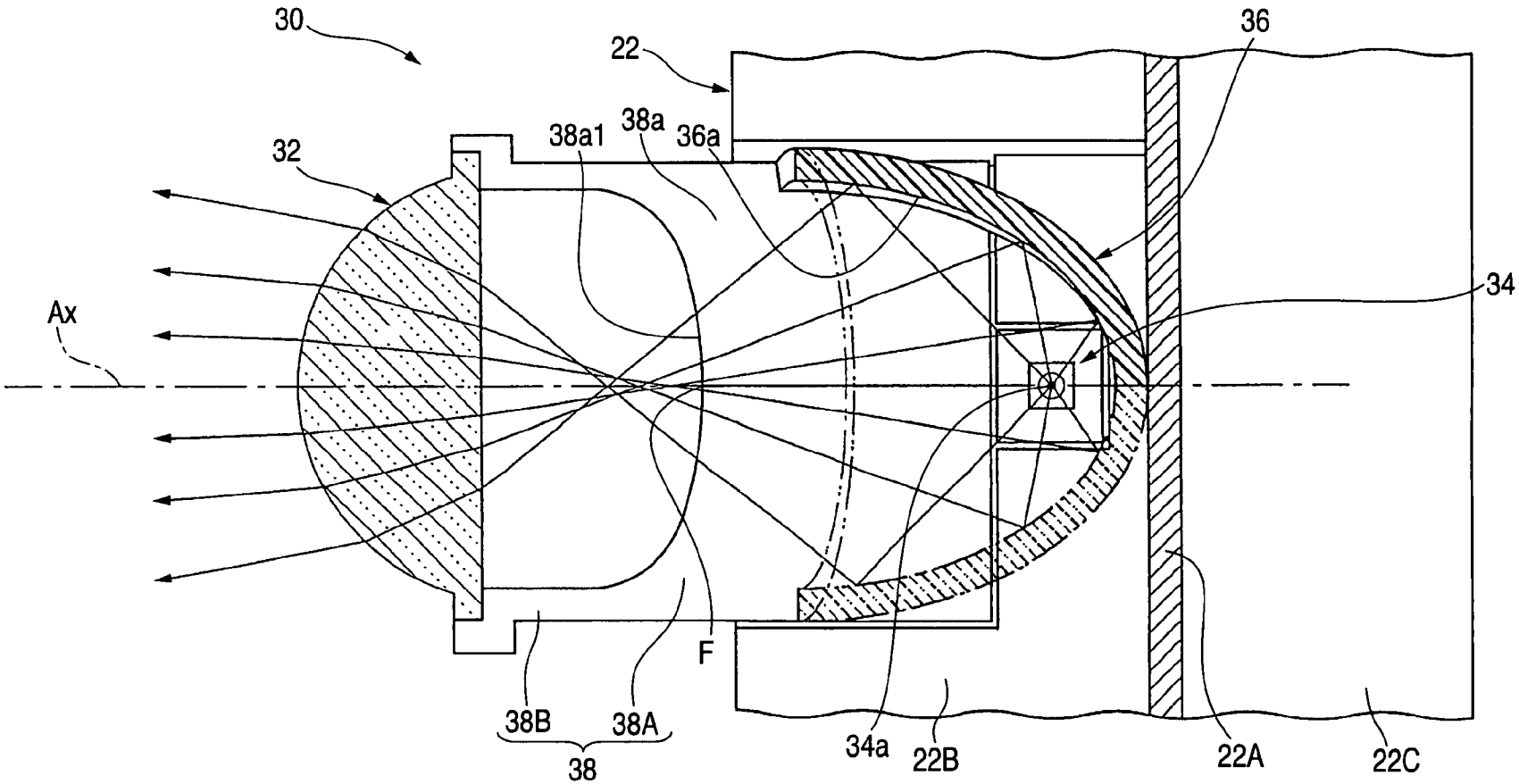
FIG. 5 is a plane sectional view of the lamp piece unit shown in FIG. 4 according to the exemplary, non-limiting embodiment of the present invention.

FIGS. 4 and 5 are a side sectional view and a plane sectional view showing details of one of the three lamp piece units 30 disposed at the upper stage in the first lamp piece unit 20, according to the exemplary, non-limiting embodiment of the present invention.

The lamp piece unit 30 includes a projecting lens 32 arranged on the optical axis Ax extended in the front and rear direction of the vehicle, a semiconductor light emitting element 34 arranged on a rear side of the projecting lens 32, a reflector 36 arranged to cover the semiconductor light emitting element 34 from an upper side, and a light control member 38 arranged between the semiconductor light emitting element 34 and the projecting lens 32.

The projecting lens 32 is constituted by a flat convex lens, a surface on a front side of which is constituted by a convex face and a surface on a rear side of which is constituted by a plane. A focal length f1 is set to be a comparatively short value.

The semiconductor light emitting element 34 is a white light emitting diode having a light emitting chip 34*a* having a size of about 0.3 through 1 mm square and is constituted to emit light at a color temperature of about 4000 through 6500 K. The semiconductor light emitting element 34 is fixed to the unit support portion 22B of the support bracket 22 in a state in which the light emitting chip 34*a* is arranged to direct upwardly in a vertical line on the optical axis Ax.

The reflector 36 is constituted to reflect light from the semiconductor light-emitting element 34 to a side of the optical axis Ax to direct to a front direction to converge substantially to a vicinity of a focal point F on a rear side of the projecting lens 32. More specifically, a sectional shape of a reflecting face 36*a* of the reflector 36 including the optical axis Ax is set substantially to an elliptical shape, and an eccentricity thereof is set to gradually increase from a vertical section to a horizontal section. Further, the reflecting face 36*a* converges light from the semiconductor light-emitting element 34 substantially to a position slightly frontward from the rear side focal point F. The reflector 36 is fixed to the unit support portion 22B of the support bracket 22 at a lower end portion of a peripheral edge thereof.

The light control portion 38 comprises a light control portion 38A, an upper face 38*a* of which is formed substantially in an angle-like shape in a front view of the lamp piece, and a lens holder portion 38B formed to extend in a front direction from a front end portion of the light control portion 38A.

The upper face 38*a* of the light control portion 38A is extended from the rear side focal point F of the projecting lens 32 in a rear direction, a region thereof on the left side of the optical axis Ax (right side in front view of the lamp piece) is extended horizontally from the optical axis Ax in the left direction, and a region thereof on the right side of the optical axis Ax is constituted by a plane extended from the optical axis Ax in the right direction in a skewed downward direction (for example, downward by about 15°). A front end edge 38*a*1 of the upper face 38*a* is formed substantially in a shape of a circular arc along a focal face of the rear side focal point F of the projecting lens 32. The upper face 38*a* is subjected to a reflecting face treatment by aluminum vapor deposition or the like. Thereby, the upper face 38*a* is constituted as the reflecting face.

Further, the light control portion 38A is constituted to hamper straight advancement of a portion of reflected light from the reflecting face 36*a* of the reflector 36 to reflect upwardly in the upper face 38*a*. Further, the light control portion 38A is fixed by the unit support portion 22B of the support bracket 22 at a lower face thereof.

The lens holder portion 38B extends in the front direction by being bent downwardly from the front end portion of the light control portion 38A to support the projecting lens 32 at a front end portion thereof.

Figure 6:
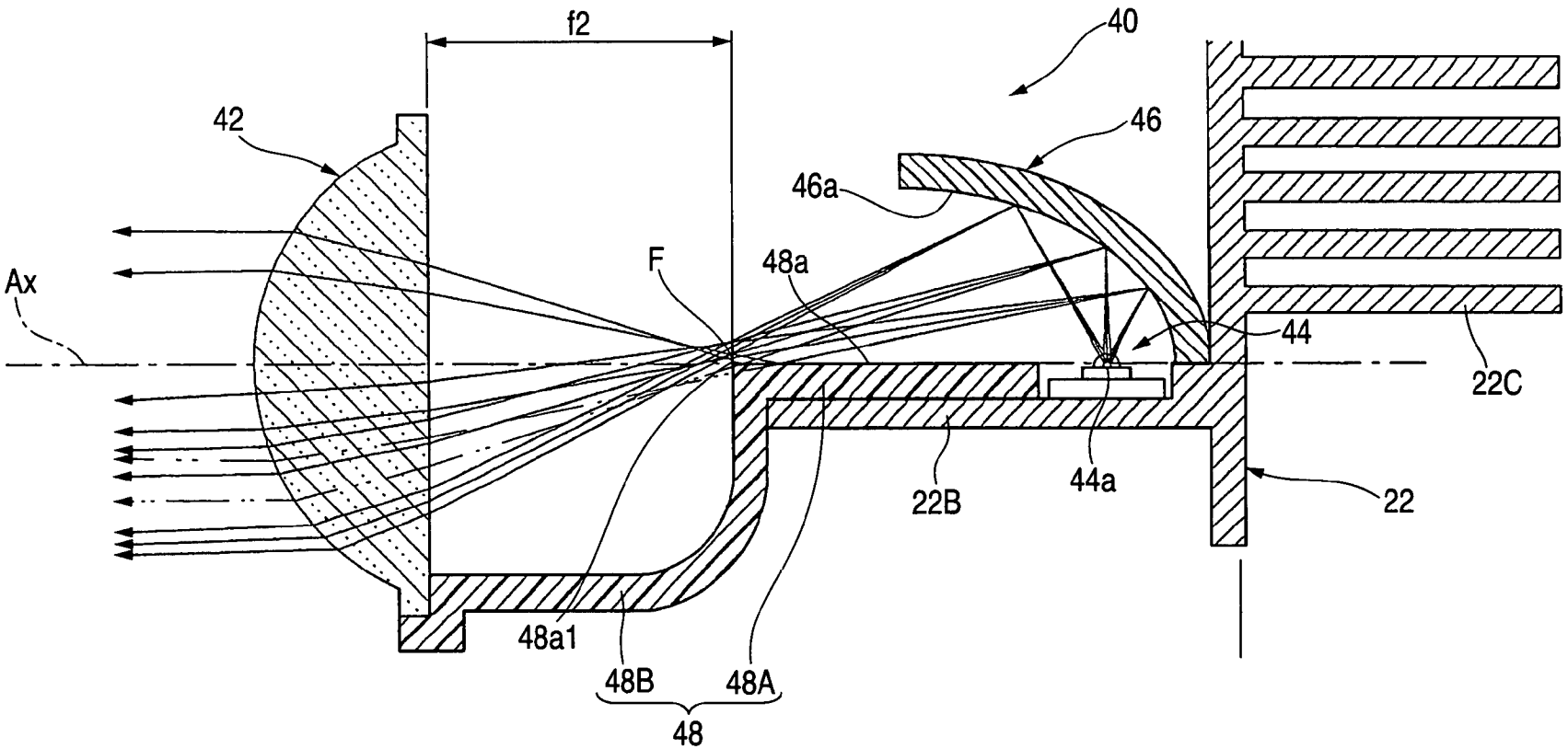
FIG. 6 is a side sectional view showing details of one of three lamp piece units disposed at a lower stage in the first lamp piece unit according to the exemplary, non-limiting embodiment of the present invention.
Figure 7:
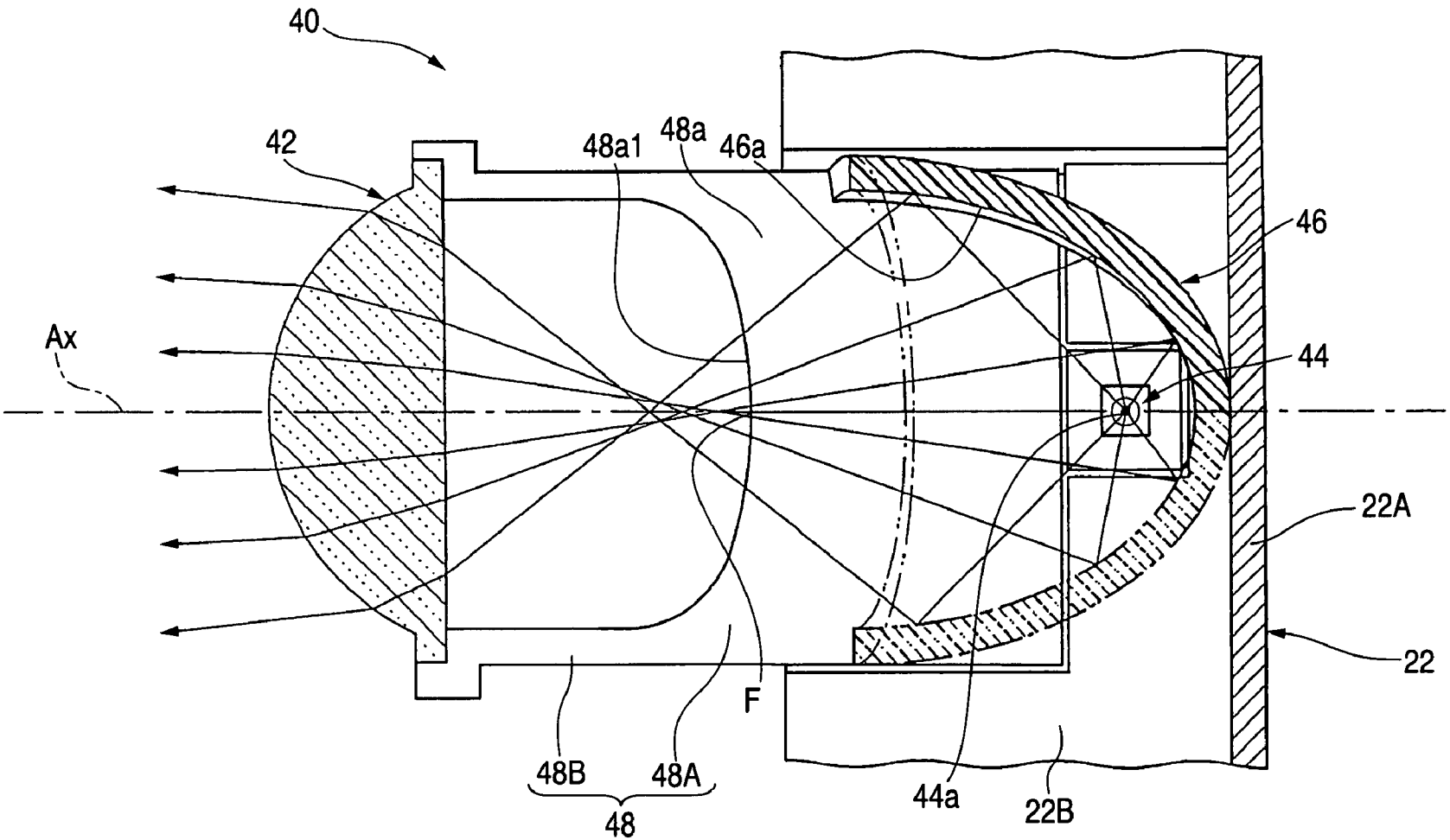
FIG. 7 is a plane sectional view of the lamp piece unit shown in FIG. 6 according to the exemplary, non-limiting embodiment of the present invention.

FIGS. 6 and 7 are a side sectional view and a plane sectional view showing details of one of the three lamp piece units 40 disposed on the lower stage in the first lamp piece unit 20, according to an exemplary, non-limiting embodiment of the present invention.

In the lamp piece unit 40, constitutions of a semiconductor light emitting element 44 and a reflector 46 are similar to those of the semiconductor light emitting element 34. Further, the reflector 36 of the lamp piece unit 30 and a projecting lens 42 and a light control member 48 are quite similar to the projecting lens 32 and the light control member 38 of the lamp piece unit 30 except for the following point.

A focal length f2 of the projecting lens 42 is set to a value larger than the focal length f1 of the projecting lens 32 of the lamp piece unit 30. In correspondence therewith, according to the light control member 48, a length in a front and a rear direction of the lens holder portion 48B is set to a value larger than that of the lens holder portion 38B of the lamp piece unit 30.

As shown by FIGS. 1 and 3, the second lamp piece unit 60 is a lamp piece unit of a parabola type and includes an electric discharge bulb 62 arranged on the optical axis Ax extended in the front and the rear direction of the vehicle, and a reflector 64 arranged on the rear side of the electricity discharge bulb 62.

The electricity discharge bulb 62 is a metal halide bulb for emitting light at color temperature of about 4000 through 5000 K and is fixed to the reflector 64 at a rear end portion thereof.

A reflecting face 64*a* of the reflector 64 is formed with a plurality of reflecting elements 64*s* on a paraboloid of revolution constituting a focal point by a center position of a light emitting portion 62*a* of the electricity discharge bulb 62 and light from the electric discharge bulb 62 is diffused to reflect or deflected to reflect in a front direction by the respective reflecting elements 64*s*.

Figure 8A:
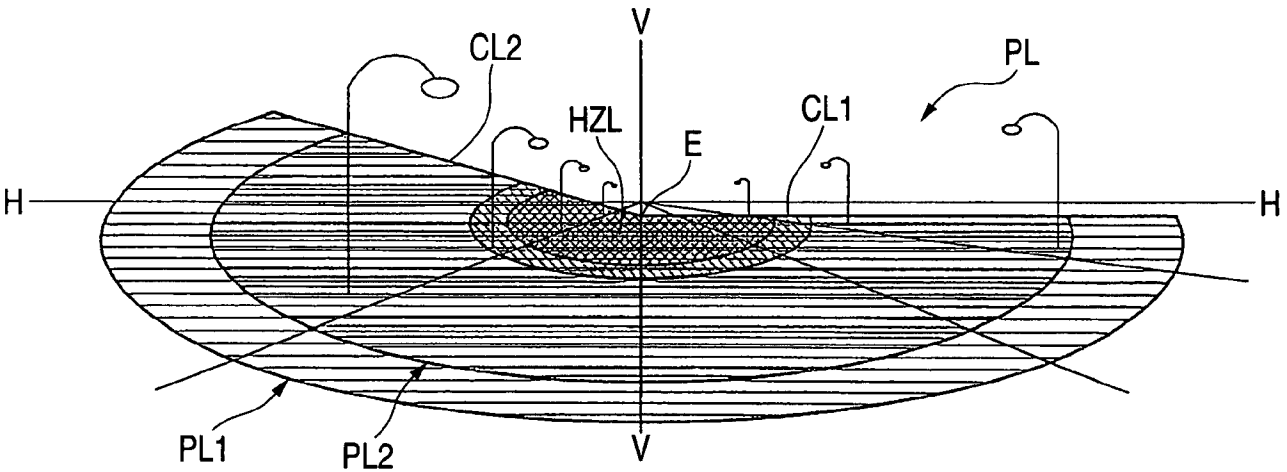
FIG. 8(*a*) is a perspective view showing a light intensity distribution pattern for low beam and FIG. 8(*b*) is a perspective view showing a light intensity distribution pattern for high beam, formed by light irradiated in a front direction from the vehicular headlamp on an imaginary vertical screen arranged at a position of 25 m in front of a lamp piece, according to the exemplary, non-limiting embodiment of the present invention.
Figure 8B:
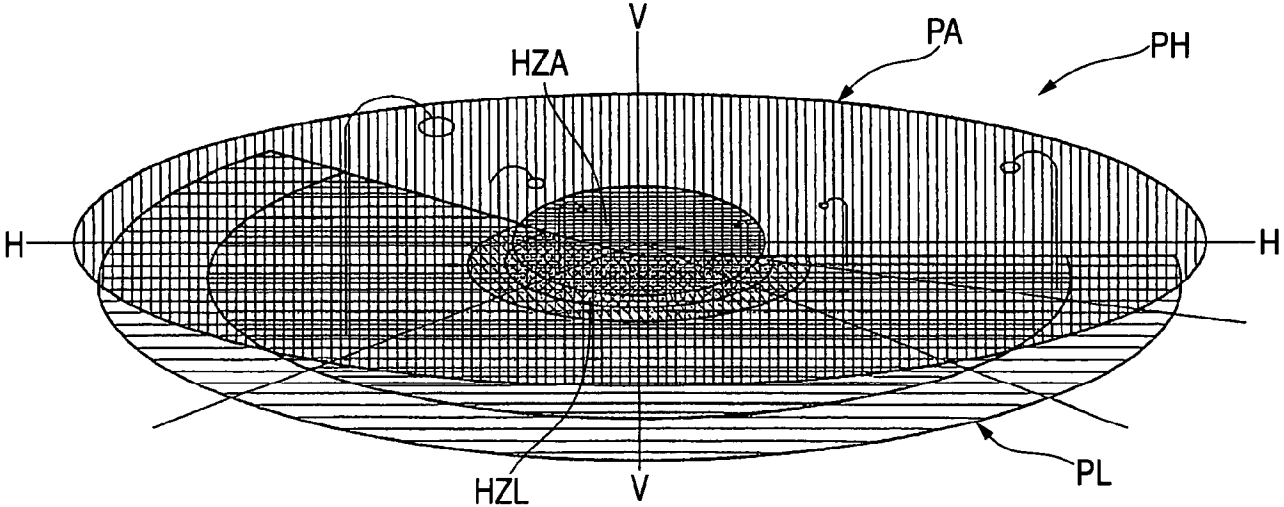

FIGS. 8(*a*)–8(*b*) illustrate perspective views showing a light intensity distribution pattern formed on an imaginary vertical screen arranged at a position 25 m in front of a lamp piece by light irradiated in a front direction from the vehicular headlamp 10 according to the embodiment. FIG. 8(*a*) shows a light intensity distribution pattern for low beam formed in a low beam mode, and FIG. 8(*b*) shows a light intensity distribution pattern for high beam formed in a high beam mode.

As shown by FIG. 8(*a*), the light intensity distribution pattern PL for the low beam is a light intensity distribution pattern for the low beam of a left intensity distribution formed by irradiated light from the first lamp piece unit 20, including a horizontal cutoff line CL 1 and a skewed cutoff line CL 2 rising from the horizontal cutoff line CL 1 by a predetermined angle (for example, about 15°) at an upper end edge thereof, and an apposition of an elbow point E which is an intersection of the two cutoff lines CL 1, CL 2 is set to a position at a position downward from H-V which is a vanishing point in a lamp piece front direction by about 0.5 through 0.6°. Further, in the light intensity distribution pattern PL for low beam, a hot zone HZL constituting a high light intensity region is formed to surround the elbow point E.

The light intensity distribution pattern PL for low beam is formed as a light intensity distribution pattern synthesized with three of the light intensity distribution patterns PL 1 formed by irradiated light from three of the lamp piece units 30 disposed at the upper stage, and three of the light intensity distribution patterns PL 2 formed by irradiated light from three of the lamp piece units 40 disposed at the lower stage.

Figure 9A:
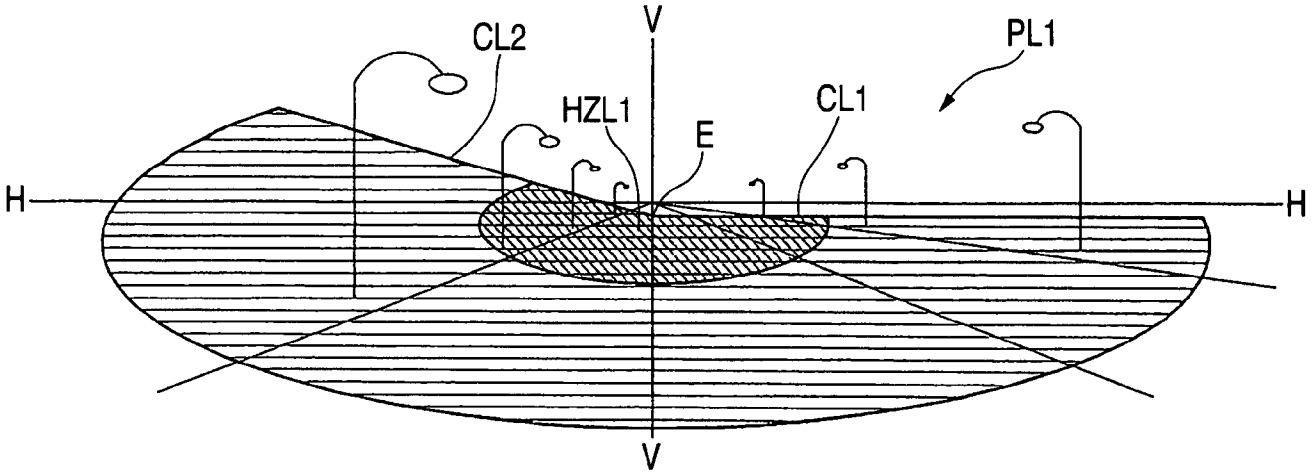
FIG. 9(*a*) is a view showing a light intensity distribution pattern for a low beam formed by irradiated light from the lamp piece unit shown in FIG. 4, and FIG. 9(*b*) is a view showing a light intensity distribution pattern for a low beam formed by irradiated light from the lamp piece unit shown in FIG. 6, according to the exemplary, non-limiting embodiment of the present invention.
Figure 9B:
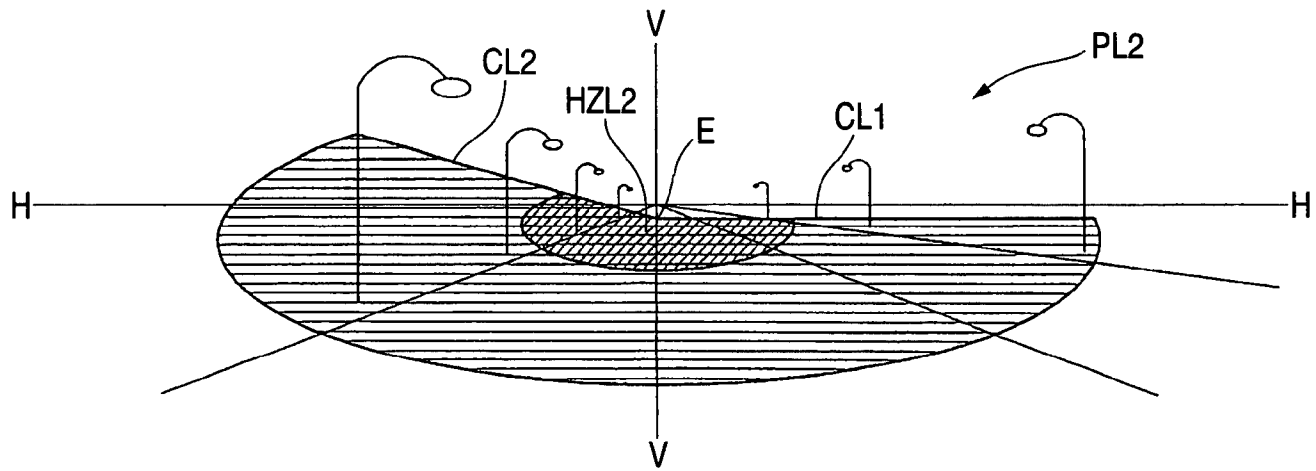

As shown by FIG. 9(*a*), in the light intensity distribution pattern PL 1, as a invertedly projected image of the front end edge 38*a* 1 of the upper face 38*a* of the light control member 38, the horizontal and the skewed cutoff lines CL 1, CL 2 are formed. In this case, since the upper face 38*a* of the light control member 38 is constituted as the reflecting face, also light in the reflected light from the reflecting face 36*a* of the reflector 36 to be emitted upwardly from the projecting lens 32 as shown by two-dotted chain lines in FIG. 4 is utilized as light emitted downwardly from the projecting lens 32 as shown by bold lines in the drawing by the reflecting operation of the upper face 38*a*. Further, thereby, a rate of utilizing a light flux of light emitted from the semiconductor light emitting element 34 is increased, and the hot zone HZL 1 is formed.

Further, as shown by FIG. 9(*b*) in the light intensity distribution pattern PL 2 as an invertedly projected image of a front end edge 48*a* 1 of an upper face 48*a* of the light control member 48, horizontal and skewed cutoff lines CL 1, CL 2 are formed. In this case, the upper face 48*a* of the light control member 48 is constituted as a reflecting face. Therefore, light reflected from a reflecting face 46*a* of the reflector 46 to be emitted upwardly from the projecting lens 42 as shown by two-dotted chain lines in FIG. 6 is utilized as light emitted downwardly from the projecting lens 42 as shown by bold lines in the drawing by reflecting operation of the upper face 48*a*. Further, thereby, a rate of utilizing a light flux of light emitted from the semiconductor light emitting element 44 is increased and a hot zone HZL 2 is formed.

The light intensity distribution pattern PL 2 is made to be smaller and brighter than the light intensity distribution pattern PL 1 since the focal length f2 of the projecting lens 42 is set to be a value larger than the focal length f1 of the projecting lens 32, and also the hot zone HZL 2 is made to be smaller and brighter than the hot zone HZL 1 of the light intensity distribution pattern PL 1.

Meanwhile, as shown by FIG. 8(*b*), a light intensity distribution pattern PH for high beam is formed as a light intensity distribution pattern synthesized with the light intensity distribution pattern PL for low beam and an additional light intensity distribution pattern PA. The additional light intensity distribution pattern PA is a light intensity distribution pattern formed by light irradiated from the second lamp piece unit 60 and is expanded significantly in a horizontal direction centering on H-V and a hot zone HZA is formed at a center position thereof.

As has been explained above, as the first lamp piece unit 20 which is lighted in the low beam mode, the pluralities of the lamp piece units 30, 40 constituting the light sources by the semiconductor light emitting elements 34, 44 are used. Therefore, the light intensity distribution control in the low beam mode can accurately be carried out.

Further, as the second lamp piece unit 60 which is lighted additionally in the high beam mode, the lamp piece unit constituting the light source by the electric discharge bulb 62 having a large amount of emitted light is used. Therefore, although only the single lamp piece unit is additionally lighted, an amount of irradiated light in the high beam mode can sufficiently be ensured. Thereby, the degree of freedom of design of the lamp piece can be promoted without considerably increasing a number of the lamp piece units.

At this occasion, according to the electric discharge bulb 62, similar to the semiconductor light emitting elements 34, 44, since color temperature of emitted light is high, when the beam is switched from the low beam to the high beam, pale irradiated light from the first lamp piece unit 20 is added with pale irradiated light from the second lamp piece unit 60. Therefore, a strange or unusual visual feeling is not given to a driver or the like in switching the beam. Further, even in the high beam mode in which the first and the second lamp piece units 20, 60 are simultaneously lighted, there is a feeling of unity in color between the two lamp piece units 20, 60. Therefore, the outlook of the lamp piece is not deteriorated.

In this way, in switching the beam between the low beam and the high beam, the unusual visual feeling is not given to the driver or the like, and the outlook of the lamp piece when irradiated in the high beam mode can be improved.

Particularly, white light emitting diodes for emitting light at color temperature of about 4000 through 6500 K are used as the semiconductor light emitting elements 34, 44, a metal halide bulb for emitting light at color temperature of about 4000 through 5000 K is used as the electric discharge bulb 62 and therefore, irradiated light from the first lamp piece unit 20 and irradiated light from the second lamp piece unit 60 can be made to constitute uniformly in colors substantially to the same degree, thereby, the operation and effect can further be improved.

Further, the respective lamp piece units 30, 40 constituting the first lamp piece unit 20 are constituted as lame piece units of a projector type. Therefore, the rate of utilizing the light flux with respect to light from the semiconductor light emitting elements 34, 44 can sufficiently be promoted, thereby, a number of the lamp piece units 30, 40 constituting the first lamp piece unit 20 can be restrained to be small. More specifically, the number of the lamp piece units 30, 40 can be restrained to be six (although not limited thereto).

Additionally, the second lamp piece unit 60 is constituted as the lamp piece unit of the parabola type. Therefore, the depth can be made to be comparatively short. Thereby, the second lamp piece unit 60 can be prevented from being considerably projected to the rear side relative to the respective lamp piece units 30, 40 constituting the first lamp piece unit 20.

Although according to the embodiment an explanation has been given such that the light intensity distribution pattern PL for low beam formed by irradiated light from the first lamp piece unit 20 includes the horizontal and the skewed cutoff lines CL 1, CL 2 at the upper end edge, the light intensity distribution pattern PL for low beam may naturally include cutoff lines other than these (for example but not by way of limitation, a pair of left and right horizontal cutoff lines formed with a stepped difference therebetween and in steps or the like).

According to the above-described embodiment, an explanation has been given such that as the plurality of lamp piece units constituting the first lamp piece unit 20, six of the lamp piece units 30, 40 are arranged in two upper and lower stages of threes thereof. However, the first lamp piece unit 20 may be constituted by a different number of pieces and/or a different arrangement. Further, a total or a portion of the plurality of lamp piece units can be constituted as lamp piece unit other than that of the projector type (for example but not by way of limitation, a lamp piece unit of a parabola type or a direct irradiating type or the like).

Although the above-described exemplary, non-limiting embodiment is constructed by the constitution in which the reflecting face 64*a* of the reflector 64 in the second lamp piece unit 60 is constituted by the plurality of reflecting elements 64*s* on the paraboloid of revolution, the reflecting face 64*a* can also be constituted by a paraboloid of revolution per se. Further, the second lamp piece unit 60 can also be constituted by a lamp piece unit of other than the parabola type (for example but not by way of limitation, lamp piece unit of a projected type or the like).

It will be apparent to those skilled in the art that various modifications and variations can be made to the described preferred embodiments of the present invention without departing from the spirit or scope of the invention. Thus, it is intended that the present invention coverall modifications and variations of this invention consistent with the scope of the appended claims and their equivalents.

The invention claimed is:

1. A vehicular headlamp that is switchable between a low beam mode and a high beam mode, comprising:

a first lamp piece unit, comprising a plurality of lamp piece units each having a semiconductor light emitting element as its light source; and a second lamp piece unit, comprising an electric discharge bulb as its light source, wherein the first lamp piece unit is lighted in the low beam mode, and the first lamp piece unit and the second lamp piece unit are lighted substantially simultaneously in the high beam mode, wherein the semiconductor light emitting element emits light at a color temperature of about 4000 through 6500 K, and the electric discharge bulb emits light at a color temperature of about 4000 through 5000 K.

2. The vehicular headlamp of claim 1, wherein the semiconductor light emitting element comprises a white light emitting diode for emitting light at the color temperature of about 4000 through 6500 K, and the electric discharge bulb comprises a metal halide bulb for emitting light at the color temperature of about 4000 through 5000 K.

3. The vehicular headlamp according to claim 1, wherein each of the lamp piece units of the first lamp piece unit includes a projecting lens and a reflector that reflects light from the semiconductor light emitting element in a front direction on a rear side of the projecting lens, wherein a reflecting face of the reflector is configured to converge light from the semiconductor light emitting element reflected by the reflecting face substantially to a vicinity of a focal point on a rear side of the projecting lens.

4. The vehicular headlamp according to claim 1, wherein the second lamp piece unit includes:

a reflector that reflects light from the electric discharge bulb in a front direction, and a reflecting face of the reflector comprising a reference face formed by a paraboloid of revolution having a focal point substantially by a position of a light emitting portion of the electric discharge bulb.

5. The vehicular headlamp of claim 1, wherein said vehicle headlamp is inclinable in an up direction, a down direction, a left direction and a right direction.

6. The vehicular headlamp of claim 1, further comprising a support bracket that supports said first lamp piece unit via a plurality of support portions corresponding to said plurality of lamp piece units, wherein a heat sink portion extends from said plurality of support portions.

7. The vehicular headlamp of claim 6, wherein said heat sink portion comprises a plurality of heat fins.

8. The vehicular headlamp of claim 1, wherein an optical axis of said first lamp piece unit is directed downward by about 0.5 to 0.6 degrees.

9. The vehicular headlamp of claim 1, wherein the first lamp piece unit comprises a first semiconductor lamp piece unit and a second semiconductor lamp piece unit and a focal length of the first semiconductor lamp piece unit is substantially shorter than a focal length of said second semiconductor lamp piece unit, wherein the focal length of said first semiconductor lamp piece unit extends rearward from a first lens mounted in front of a first light emitting chip and the focal length of the second semiconductor lamp piece unit extends rearward from a second lens mounted in front of a second light emitting chip.

10. The vehicular headlamp of claim 1, wherein said electric discharge bulb comprises a metal halide bulb.

11. The vehicular headlamp of claim 1, wherein said plurality of lamp piece units comprises a first group of said lamp piece units positioned above a second group of said lamp piece units, and said plurality of lamp piece units are positioned substantially next to said second lamp piece unit.

12. The vehicular headlamp of claim 1, wherein said first lamp piece unit and said second lamp piece unit generate a substantially same color.

* * * * *